US009288577B2

(12) United States Patent
Zhang et al.

(10) Patent No.: US 9,288,577 B2
(45) Date of Patent: Mar. 15, 2016

(54) PRESERVING PHASE SHIFT IN SPATIAL FILTERING

(71) Applicant: LENOVO (Singapore) PTE, LTD., New Tech Park (SG)

(72) Inventors: Jianbang Zhang, Raleigh, NC (US); Jian Li, Chapel Hill, NC (US); John Weldon Nicholson, Cary, NC (US); Steven Richard Perrin, Raleigh, NC (US)

(73) Assignee: Lenovo (Singapore) PTE. LTD., New Tech Park (SG)

( * ) Notice: Subject to any disclaimer, the term of this patent is extended or adjusted under 35 U.S.C. 154(b) by 283 days.

(21) Appl. No.: 13/953,433

(22) Filed: Jul. 29, 2013

(65) Prior Publication Data

US 2015/0030179 A1 Jan. 29, 2015

(51) Int. Cl.
*H04R 3/00* (2006.01)

(52) U.S. Cl.
CPC ..... *H04R 3/005* (2013.01); *H04R 2499/15* (2013.01)

(58) Field of Classification Search
None
See application file for complete search history.

(56) References Cited

U.S. PATENT DOCUMENTS

| | | | | |
|---|---|---|---|---|
| 6,594,367 | B1 * | 7/2003 | Marash et al. | 381/92 |
| 7,970,609 | B2 * | 6/2011 | Hayakawa | 704/238 |
| 2014/0219471 | A1 * | 8/2014 | Deshpande et al. | 381/92 |
| 2014/0241549 | A1 * | 8/2014 | Stachurski et al. | 381/92 |

* cited by examiner

*Primary Examiner* — Brenda Bernardi
(74) *Attorney, Agent, or Firm* — Kunzler Law Group

(57) ABSTRACT

For preserving phase shift in spatial filtering is disclosed, an electronic device includes a microphone array. A filtering module spatially filters a plurality of received audio signals from the microphone array to increase the signal-to-noise ratio in one or more corresponding output audio signals. A phase module preserves a phase shift of at least one received audio signal in the corresponding output audio signal.

20 Claims, 7 Drawing Sheets

PRESERVING PHASE SHIFT IN SPATIAL FILTERING

FIELD

The subject matter disclosed herein relates to spatial filtering and more particularly relates to preserving phase shifts in spatial filtering.

BACKGROUND

Description of the Related Art

Spatial filtering techniques such as beamforming are often used to increase the signal-to-noise ratio of audio signals from microphone arrays. Unfortunately, the spatial filtering removes the phase shift information.

BRIEF SUMMARY

An apparatus for preserving phase shift in spatial filtering is disclosed. The apparatus includes an electronic device, a filtering module, and a phase module. The electronic device includes a microphone array. The filtering module spatially filters a plurality of received audio signals from the microphone array to increase the signal-to-noise ratio in one or more corresponding output audio signals. The phase module preserves a phase shift of at least one received audio signal in the corresponding output audio signal. The filtering module and the phase module comprise at least one of semiconductor hardware and a memory storing machine readable code executable by a processor. A method and program product also perform the functions of the apparatus.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Figure 1:
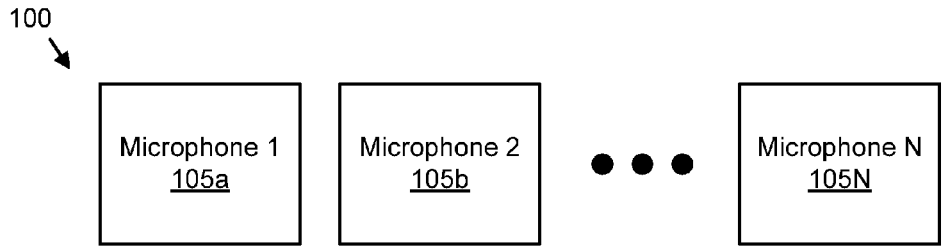
FIG. 1 is a schematic block diagram illustrating one embodiment of a microphone array.

As will be appreciated by one skilled in the art, aspects of the embodiments may be embodied as a system, method or program product. Accordingly, embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments may take the form of a program product embodied in one or more computer readable storage devices storing machine readable code. The storage devices may be tangible, non-transitory, and/or non-transmission.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in machine readable code and/or software for execution by various types of processors. An identified module of machine readable code may, for instance, comprise one or more physical or logical blocks of executable code which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of machine readable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different computer readable storage devices, and may exist, at least partially, merely as electronic signals on a system or network. Where a module or portions of a module are implemented in software, the software portions are stored on one or more computer readable storage devices.

Any combination of one or more computer readable medium may be utilized. The computer readable medium may be a machine readable signal medium or a storage device. The computer readable medium may be a storage device storing the machine readable code. The storage device may be, for example, but not limited to, an electronic, magnetic, optical, electromagnetic, infrared, holographic, micromechanical, or semiconductor system, apparatus, or device, or any suitable combination of the foregoing.

More specific examples (a non-exhaustive list) of the storage device would include the following: an electrical connection having one or more wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A machine readable signal medium may include a propagated data signal with machine readable code embodied therein, for example, in baseband or as part of a carrier wave. Such a propagated signal may take any of a variety of forms, including, but not limited to, electro-magnetic, optical, or any suitable combination thereof. A machine readable signal medium may be any storage device that is not a computer readable storage medium and that can communicate, propagate, or transport a program for use by or in connection with an instruction execution system, apparatus, or device. Machine readable code embodied on a storage device may be transmitted using any appropriate medium, including but not limited to wireless, wire line, optical fiber cable, Radio Frequency (RF), etc., or any suitable combination of the foregoing.

Machine readable code for carrying out operations for embodiments may be written in any combination of one or more programming languages, including an object oriented programming language such as Java, Smalltalk, C++ or the like and conventional procedural programming languages, such as the "C" programming language or similar programming languages. The machine readable code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to," unless expressly specified otherwise. An enumerated listing of items does not imply that any or all of the items are mutually exclusive, unless expressly specified otherwise. The terms "a," "an," and "the" also refer to "one or more" unless expressly specified otherwise.

Furthermore, the described features, structures, or characteristics of the embodiments may be combined in any suitable manner. In the following description, numerous specific details are provided, such as examples of programming, software modules, user selections, network transactions, database queries, database structures, hardware modules, hardware circuits, hardware chips, etc., to provide a thorough understanding of embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

Aspects of the embodiments are described below with reference to schematic flowchart diagrams and/or schematic block diagrams of methods, apparatuses, systems, and program products according to embodiments. It will be understood that each block of the schematic flowchart diagrams and/or schematic block diagrams, and combinations of blocks in the schematic flowchart diagrams and/or schematic block diagrams, can be implemented by machine readable code. These machine readable code may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the schematic flowchart diagrams and/or schematic block diagrams block or blocks.

The machine readable code may also be stored in a storage device that can direct a computer, other programmable data processing apparatus, or other devices to function in a particular manner, such that the instructions stored in the storage device produce an article of manufacture including instructions which implement the function/act specified in the schematic flowchart diagrams and/or schematic block diagrams block or blocks.

The machine readable code may also be loaded onto a computer, other programmable data processing apparatus, or other devices to cause a series of operational steps to be performed on the computer, other programmable apparatus or other devices to produce a computer implemented process such that the program code which execute on the computer or other programmable apparatus provide processes for implementing the functions/acts specified in the flowchart and/or block diagram block or blocks.

The schematic flowchart diagrams and/or schematic block diagrams in the Figures illustrate the architecture, functionality, and operation of possible implementations of apparatuses, systems, methods and program products according to various embodiments. In this regard, each block in the schematic flowchart diagrams and/or schematic block diagrams may represent a module, segment, or portion of code, which comprises one or more executable instructions of the program code for implementing the specified logical function(s).

It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated Figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and machine readable code.

Descriptions of figures may refer to elements described in previous figures, like numbers referring to like elements.

FIG. 1 is a schematic block diagram illustrating one embodiment of a microphone array 100. The array includes two or more microphones 105. In one embodiment, the microphones 105 may be arranged to detect phase differences in audible signals. For example, two microphones 105 may be arranged to detect phase differences along an axis.

Figure 2A:
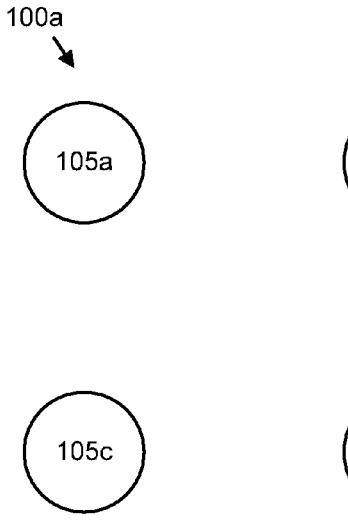
FIG. 2A-C are schematic diagrams illustrating embodiments of arrangements of microphone arrays.
Figure 2B:
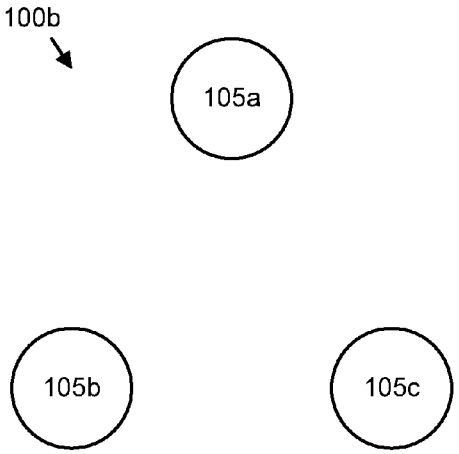
Figure 2C:
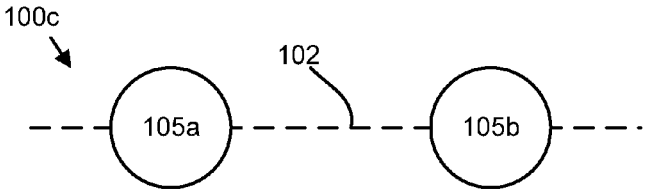

FIG. 2A-C are schematic diagrams illustrating embodiments of arrangements of microphone arrays 100*a-c*. FIG. 2A depicts four microphones 105 arranged in a square. FIG. 2B depicts three microphones 105 arranged in a triangle. FIG. 2C depicts two microphones 105 arrayed along an axis 102.

Figure 3:
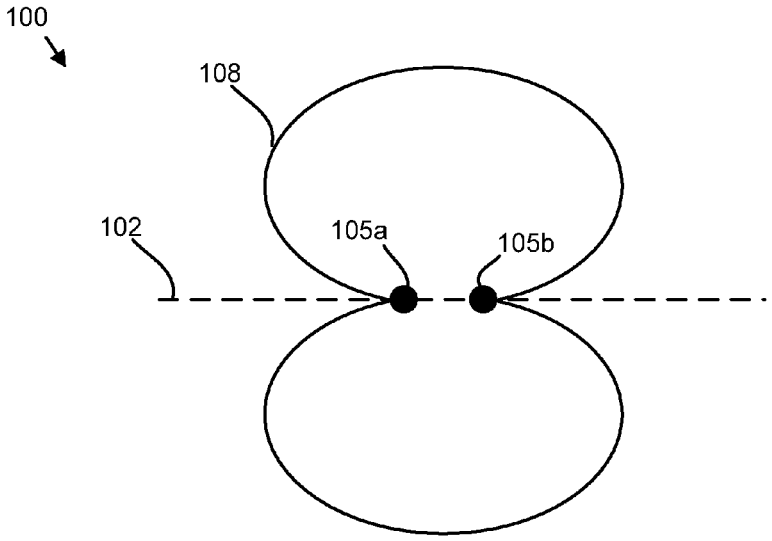
FIG. 3 is a polar plot of bidirectional coverage for a microphone array.

FIG. 3 is a polar plot illustrating a microphone array 100 with bidirectional coverage. The microphone array 100 of FIG. 2C is depicted. In addition, a polar coverage plot 108 is shown for the microphone array 100. Because an audible signal arrives at each of the microphones 105 at a slightly different time, there is a phase shift between the audio signals generated at each of the microphones 105. The information in the phase shift can be used to further enhance the quality of the audio signal generated by the microphones 105 from the received audible signal.

In the depicted embodiment, the gain of the microphones 105 in the microphone array 100 is greater for audible signals within the bidirectional coverage area 108, while audible signals outside of the bidirectional coverage area 108 are attenuated. Thus, the microphone array 100 gives the audio signal generated by the microphone array 100 a directional gain. The directional gain is useful in reducing unwanted audible signals such as background noise.

The phase shift information in the audio signals generated by the microphones 105 may be used to determine the direction of arrival, locate a source of an audible signal, separate sources of audible signals, reduce noise over multiple channels, cancel echoes, provide stereo sound, provide second stage spatial filtering, and the like.

In addition, the audio signal from a second microphone 105*b* may be used as a reference signal in spatial filtering to enhance the signal-to-noise ratio of an audio signal from a first microphone 105*a*, spatial filtering often referred to as beamforming.

In the past, the spatial filtering was performed by calculating a product of an input vector of received audio signals from the microphone array 100, referred to hereafter as VI, and a steering vector, VS, as shown in equation 1, where MO is a mono audio output signal.

$$MO=VI*VS \qquad \text{Equation 1}$$

Unfortunately, this spatial filtering removes the phase shift information from the input vector. As a result, additional spatial filtering to determine the direction of arrival, locate a source of an audible signal, separate sources of audible signals, reduce noise over multiple channels, cancel echoes, provide stereo sound, provide second stage spatial filtering, and the like cannot be performed.

The embodiments described herein spatially filter received audio signals to increase the signal-to-noise ratio while preserving a phase shift of a least one received audio signal in a corresponding output audio signal as will be described hereafter.

Figure 4:
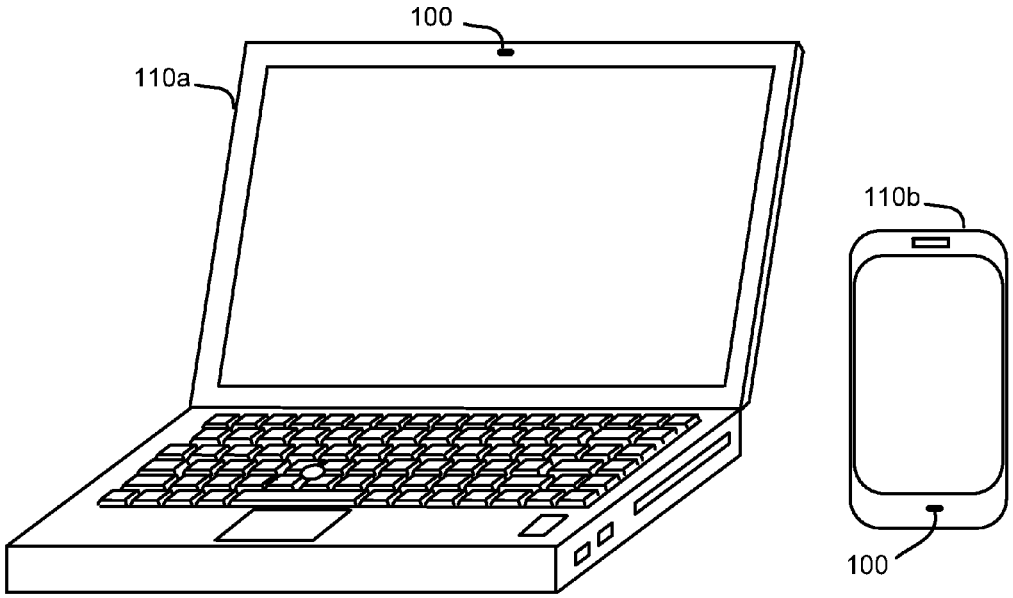
FIG. 4 is a perspective drawing illustrating embodiments of electronic devices.

FIG. 4 is a perspective drawing illustrating embodiments of electronic devices 110. A laptop computer 110*a* and a smart phone 110*b* are depicted as electronic devices 110. One of skill in the art will recognize that electronic device 110 may also be a computer workstation, a teleconference device, a tablet computer, a wearable computer, an eye-mounted computer, and the like.

Figure 5:
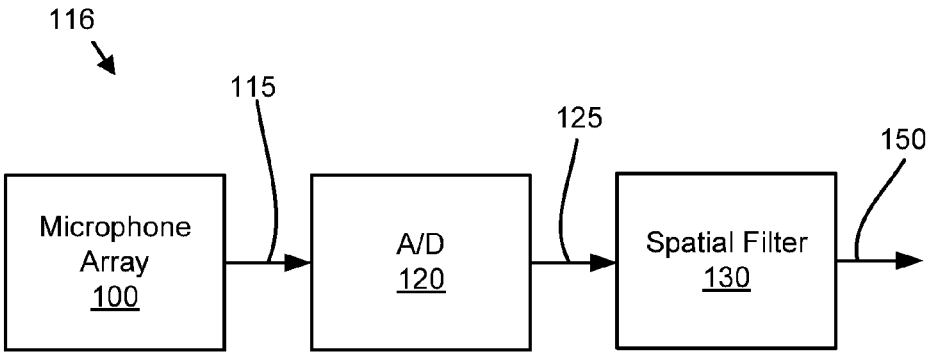
FIG. 5 is a schematic block diagram illustrating one embodiment of a spatial filtering system.

FIG. 5 is a schematic block diagram illustrating one embodiment of a spatial filtering system 116. The system 116 includes a microphone array 100, an analog-to-digital converter 120, and a spatial filter 130. The microphone array 100 receives audible signals and generates one or more analog signals 115. The analog-to-digital converter 120 converts the analog signals 115 into one or more received audio signals 125. The received audio signals 125 may be organized as the input vector VI.

The spatial filter 130 generates one or more output audio signals 150 from the received audio signals 125. The output audio signals 150 may be organized as an output vector VO. Each entry in the output vector VO may correspond to an entry in the input vector VI, with an increased signal-to-noise ratio.

Figure 6:
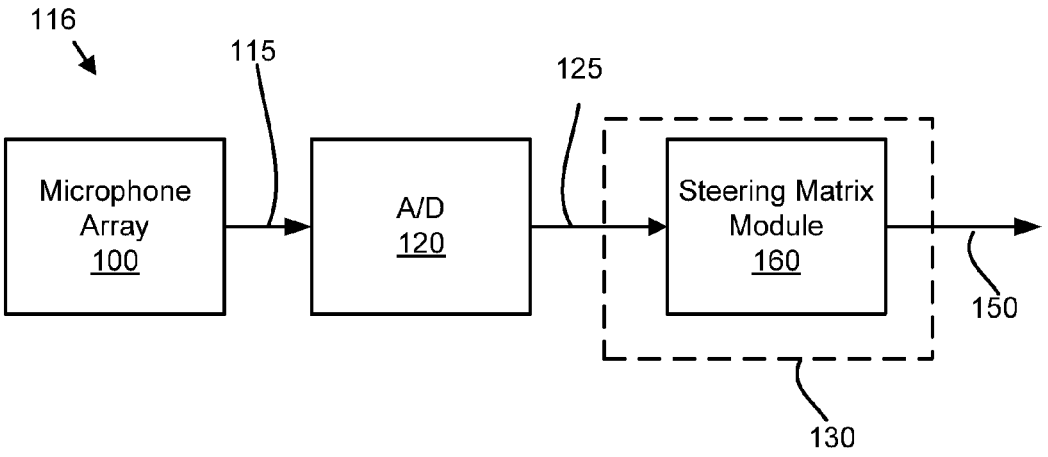
FIG. 6 is a schematic block diagram illustrating one alternate embodiment of a spatial filtering system.

FIG. 6 is a schematic block diagram illustrating one alternate embodiment of the spatial filtering system 116. The spatial filtering system 116 of FIG. 5 is shown with the spatial filter 130 comprising a steering matrix module 160. The steering matrix module 160 may employ a steering matrix VM. The steering matrix VM may be calculated as a product of an adjustment vector g and a steering vector VS as shown in equation 2.

$$VM=g*VS \qquad \text{Equation 2}$$

The steering matrix may preserve the phase shift of a least one received audio signal 125 in the corresponding output audio signal 150. The steering vector VS may be expressed in the form $[1, e^{-j\tau}, e^{-j2\tau}, \ldots e^{-j(N-1)\tau}]$ where each $\tau$ is a phase shift of received audio signal 125 in radians and j is the imaginary number $\sqrt{-1}$. In one embodiment, the adjustment vector g is the transpose of the vector $[1, e^{+j\tau}, e^{+j2\tau}, e^{+j(N-1)\tau}]$.

The steering matrix module 160 may calculate the output vector VO of the output audio signals 150 using equation 3.

$$VO=VM*VI \qquad \text{Equation 3}$$

In one embodiment, the output vector VO of the output audio signals 150 is calculated using equation 4, where h is a vector of coefficients. In one embodiment, h is a vector of non-zero coefficients $$VO=(h*VM)*VI \qquad \text{Equation 4}$$

Figure 7:
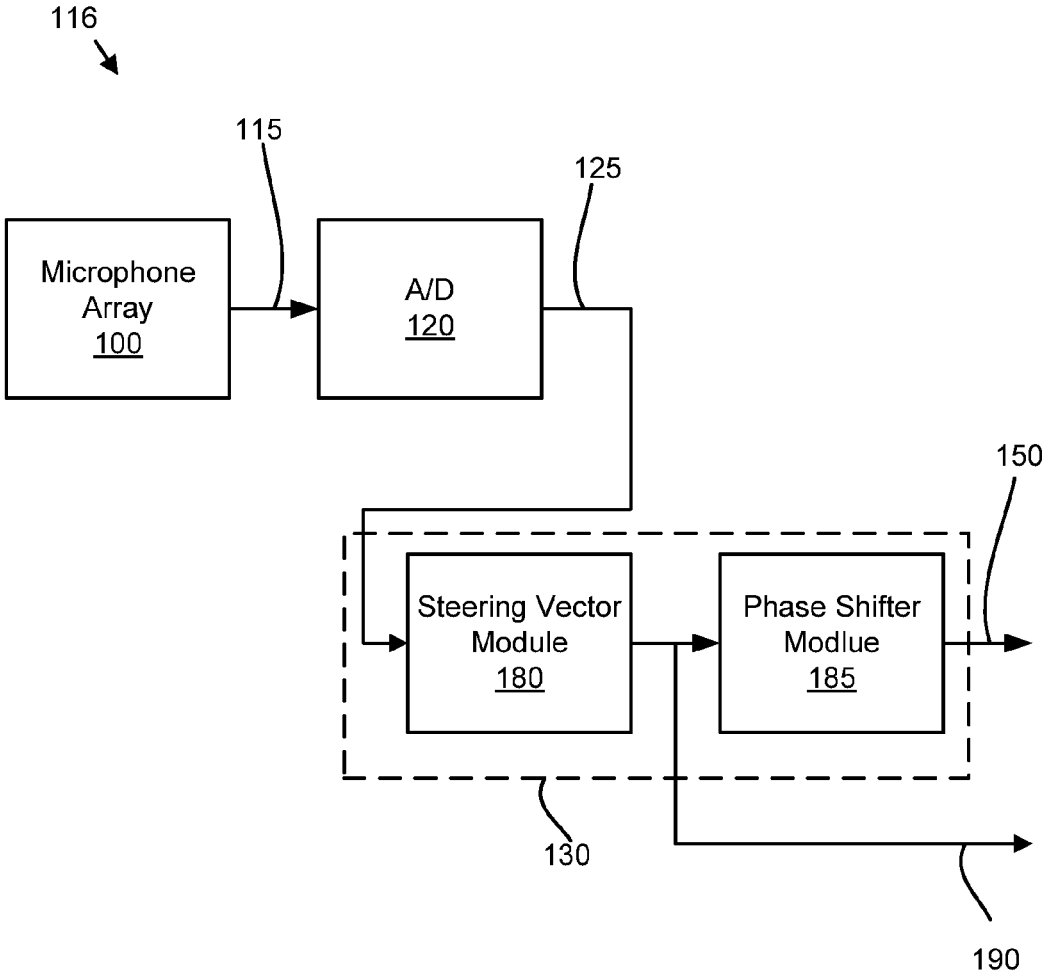
FIG. 7 is a schematic block diagram illustrating one alternate embodiment of a spatial filtering system.

FIG. 7 is a schematic block diagram illustrating one alternate embodiment of the spatial filtering system 116. The spatial filtering system 116 of FIG. 5 is shown with the spatial filter 130 comprising a steering vector module 180 and a phase shifter module 185. The steering vector module 180 may calculate a mono output audio signal 190. In one embodiment, the steering vector module 180 calculates the mono output audio signal 190 using equation 5, where M is the mono output audio signal 190.

$$M=VS\cdot VI \qquad \text{Equation 5}$$

The phase shifter module 185 may preserve the phase shift of a least one received audio signal 125 in the corresponding output audio signal 150. In one embodiment, the phase shifter module 185 shifts the mono output audio signal 190 by a predetermined phase $\tau$ to generate one or more audio output signals 150 as will be described hereafter.

Figure 8:
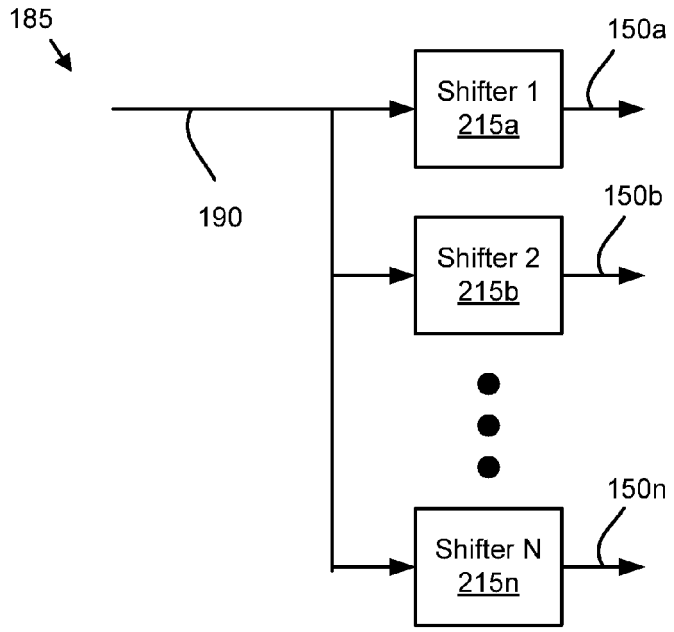
FIG. 8 is a schematic block diagram illustrating one embodiment of a phase shifter.

FIG. 8 is a schematic block diagram illustrating one embodiment of the phase shifter module 185. The phase shifter module 185 may comprise one or more shifters 215. Each shifter 215 may shift the phase of the mono output audio signal 190. In one embodiment, each shifter 215 delays the mono output audio signal 190 by a predetermined phase delay. In one embodiment, shifter 1 215*a* may correspond to a microphone 1 105*a* and have no predetermined phase delay. In addition, shifter 2 215*b* may correspond to microphone 2 105*b* and have a predetermined phase delay equivalent to the time required for sound to travel between microphone 1 105*a* and microphone 2 105*b*. Similarly, shifter N 215*n* may correspond to microphone N 105*n* and have a predetermined phase delay equivalent to the time required for sound to travel between microphone 1 105*a* and microphone N 105*n*.

Figure 9:
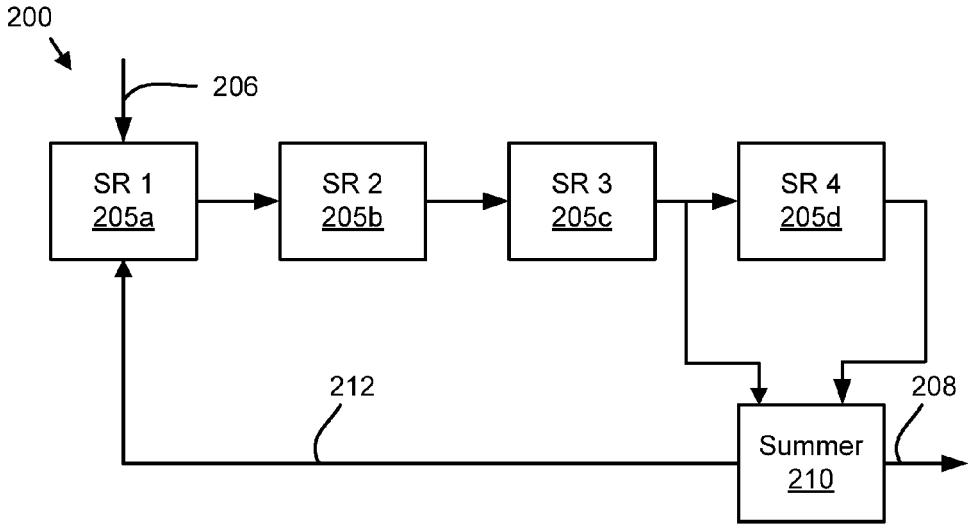
FIG. 9 is a schematic block diagram illustrating one embodiment of signal processing hardware.

FIG. 9 is a schematic block diagram illustrating one embodiment of signal processing hardware 200. The signal processing hardware 200 may be implemented in one or more semiconductor logic gates. The signal processing hardware 200 may perform the functions of the spatial filter 130. In one embodiment, the signal processing hardware 200 performs the functions of the steering matrix module 160, the steering vector module 180, and/or the phase shifter module 185.

For simplicity, four shift registers 205 and one summer 210 are shown. One of skill in the art will recognize that additional shift registers 205 and summers 210 may be employed depending on the equation being calculated.

Input signals 206 are communicated to register 1 205*a*. The input signals 206 may be one or more of elements of the received audio signals 125, the coefficients h, the steering vector VS, and/or the steering matrix VM. In addition, output signals 212 of the summer 210 may be communicated to shift register 1 205*a*. The input 206 signals received at shift register 1 205*a* are shifted and communicated to shift register 2 205*b*. Shift register 2 205*b* further shifts the signals and communicates the shifted signals to shift register 3 205*c*. In one embodiment, the output signals of register 3 205*c* are communicated to shift register 4 205*d* and to the summer 210. Shift register 4 205*d* may further shift the signals and communicate the shifted signals to the summer 210. The summer 210 may sum the shifted signals from register 3 205*c* and register 4 205*d*.

In one embodiment, an output 208 of the summer 210 is an element of the output audio signal 150, the mono output audio signal 190, and/or intermediate computational values. One of skill in the art will recognize that a plurality of registers 205 and summers 210 may be employed to calculate the equations described herein.

Figure 10:
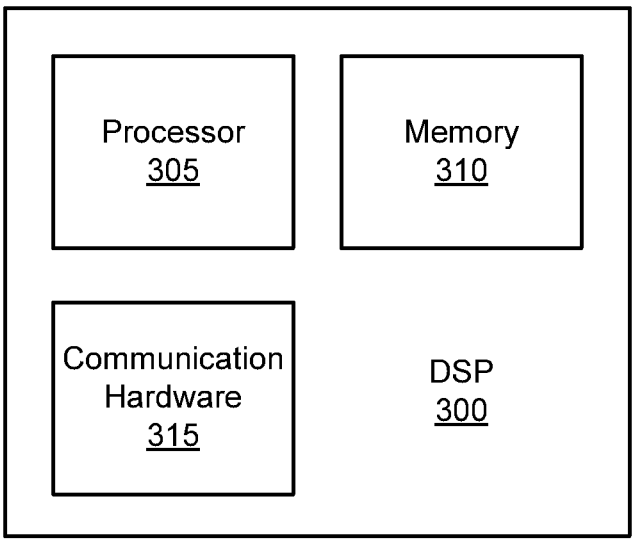
FIG. 10 is a schematic block diagram illustrating one embodiment of a digital signal processor.

FIG. 10 is a schematic block diagram illustrating one embodiment of a digital signal processor (DSP) 300. The DSP 300 may perform the functions of the spatial filter 130. In one embodiment, the DSP 300 performs the functions of the steering matrix module 160, the steering vector module 180, and/or the phase shifter module 185.

The DSP 300 includes a processor 305, a memory 310, and communication hardware 315. The memory 310 may store machine readable code. The memory 310 may be a semiconductor memory. Alternatively, the memory 310 may be a hard disk drive, an optical storage device, a micromechanical storage device, or combinations thereof.

The processor 305 may execute the machine readable code to perform functions. The communication hardware 315 may communicate with other devices.

Figure 11:
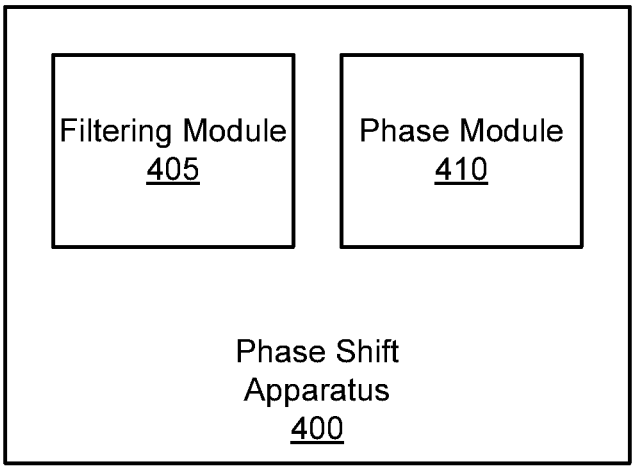
FIG. 11 is a schematic block diagram illustrating one embodiment of the phase shift apparatus.

FIG. 11 is a schematic block diagram illustrating one embodiment of the phase shift apparatus 400. The apparatus 400 includes a filtering module 405 and a phase module 410. In one embodiment, the filtering module 405 and the phase module 410 are embodied in the signal processing hardware 200. Alternatively, the filtering module 405 and the phase module 410 may be embodied in the DSP 300.

The filter module 405 spatially filters a plurality of received audio signals 125 to increase the signal-to-noise ratio in one or more corresponding output audio signals 150. The phase module 410 preserves a phase shift of at least one received audio signal 125 in the corresponding output audio signal 150.

Figure 12:
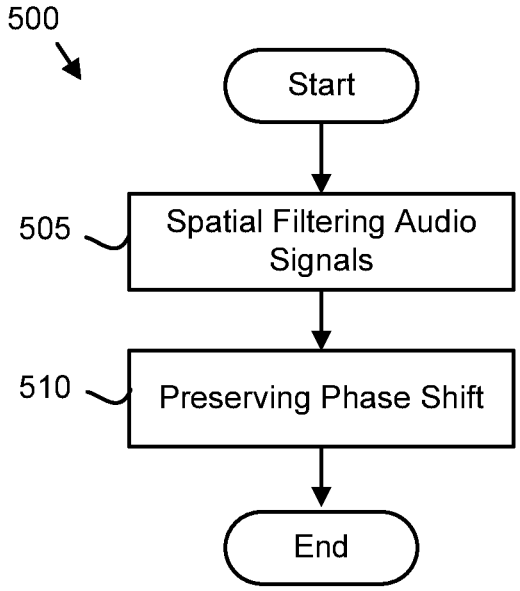
FIG. 12 is a schematic flow chart diagram illustrating one embodiment of a phase shift preservation method.

FIG. 12 is a schematic flow chart diagram illustrating one embodiment of a phase shift preservation method 500. In one embodiment, the method 500 is performed by the signal processing hardware 200. Alternatively, the method 500 is performed by the DSP. In one embodiment, the method 500 is performed by a program product. The program product may comprise a computer readable storage medium such as the memory 310. The memory 310 may store machine readable code. The machine readable code may be executable by a processor 305 to perform the functions of the method 500.

The method 500 starts, and in one embodiment, the filtering module 405 spatially filters 505 a plurality of received audio signals 125 to increase the signal-to-noise ratio in one or more corresponding output audio signals 150. For example, the mono output audio signal 190 may be calculated using the input vector VI of received audio signals 125 for two microphones 105 in the microphone array 100 and the steering vector VS using equation 5 as shown in equations 6 and 7, where the steering vector VS has elements A1 and A2 and the received audio signals 125 are VI1 and VI2.

$$M = [A1, A2] \cdot \begin{bmatrix} VI1 \\ VI2 \end{bmatrix} \qquad \text{Equation 6}$$

$$M = (A1 * VI1) + (A2 * VI2) \qquad \text{Equation 7}$$

The phase module 410 may preserve 510 the phase shift of a least one received audio signal 125 in the corresponding audio output signal 150 and the method 500 ends. In one embodiment, the mono output audio signal 190 is shifted by a predetermined phase corresponding to each received audio input signal 125. For example, the mono audio output signal 190 may be delayed by a first predetermined phase for a first audio output signal 150*a*. The first predetermined phase may be no delay. In addition, the mono audio output signal 190 may be delayed by a second predetermined phase for a second audio output signal 150*b*.

In one embodiment, the received audio signals 125 are concurrently spatially filtered 505 while preserving 510 the phase shift of each received audio signal 125 in the corresponding audio output signal 150. For example, for steering matrix VM with elements A1, A2, A3, and A4, and an input vector VI with elements of VI1 and VI2, the output vector VO of the output audio signals 150 may be calculated as shown in equations 8 and 9.

$$[VO1, VO2] = \begin{bmatrix} A1 & A2 \\ A3 & A4 \end{bmatrix} * \begin{bmatrix} VI1 \\ VI2 \end{bmatrix} \qquad \text{Equation 8}$$

$$[VO1, VO2] = [(A1 * VI1 + A2 * VI2), (A3 * VI2 + A4 * VI2)] \qquad \text{Equation 9}$$

The output vector VO includes output audio signals 150 with both increased signal-to-noise ratios and the phase shift information of the received audio inputs 125. The phase shift information can be used to further filter the output audio signals 150, to determine direction of audible signal sources, and the like.

Figure 13:
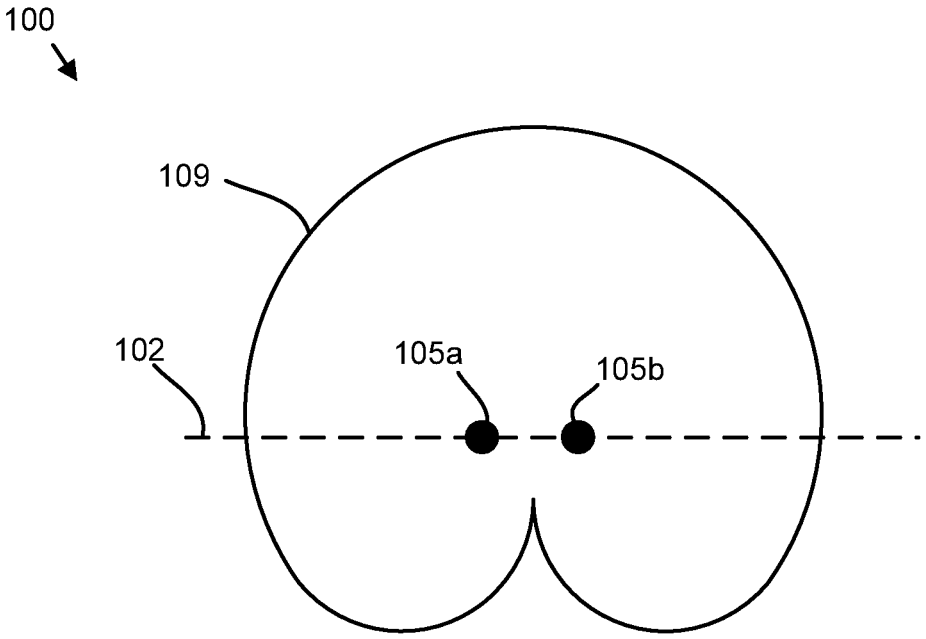
FIG. 13 is a polar plot of cardioid coverage for a microphone array.

FIG. 13 is a polar plot of cardioid coverage for a microphone array 100. With the phase shift information preserved in the output audio signals 150, the output audio signals 150 may be further filtered to have the cardioid coverage area 109, where in the microphone array gain is greater in a specified direction.

In the depicted embodiment, the preserved phase shift information is used to increase the gain of the microphone array 100 within the cardioid coverage area 109, while audible signals outside of the cardioid coverage area 109 are attenuated. One of skill in the art will recognize that the preserved phase shift information may be used to determine the direction of arrival, locate a source of an audible signal, separate sources of audible signals, reduce noise over multiple channels, cancel echoes, provide stereo sound, provide second stage spatial filtering, and the like.

The embodiments described herein preserve one or more phase shifts in the output audio signals 150 from spatially filtered received input signals. By preserving the phase shifts, the embodiments allow additional signal processing of the output audio signals 150.

Embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

an electronic device comprising a microphone array;

a filtering module spatially filtering a plurality of received audio signals from the microphone array to increase the signal-to-noise ratio in one or more corresponding output audio signals; and a phase module preserving a phase shift of at least one received audio signal in the corresponding output audio signal, wherein the filtering module and the phase module comprise one or more of semiconductor hardware and a memory storing machine readable code and a processor executing the machine readable code.

2. The apparatus of claim 1, wherein at least one of the one or more output audio signals is a mono output audio signal shifted by a predetermined phase.

3. The apparatus of claim 1, wherein the one or more output audio signals comprise an output vector of spatially filtered output audio signals with preserved phase shifts.

4. The apparatus of claim 1, wherein the one or more output audio signals is a product of an input vector and a steering matrix.

5. The apparatus of claim 4, wherein an output vector VO of the one or more output audio signals is a product of coefficients h, the input vector VI comprising the plurality of received audio signals, and the steering matrix VM, VO=(h*VM)*VI.

6. The apparatus of claim 5, wherein the steering matrix VM is calculated as a product of an adjustment vector g and a steering vector VS, VM=g*VS.

7. A method comprising:

spatially filtering a plurality of received audio signals to increase the signal-to-noise ratio in one or more corresponding output audio signals; and preserving a phase shift of at least one received audio signal in the corresponding output audio signal.

8. The method of claim 7, wherein at least one of the one or more output audio signals is a mono output audio signal shifted by a predetermined phase.

9. The method of claim 7, wherein the one or more of output audio signals comprise an output vector of spatially filtered output audio signals with preserved phase shifts.

10. The method of claim 7, wherein the one or more output audio signals is a product of an input vector and a steering matrix.

11. The method of claim 10, wherein an output vector VO of the one or more output audio signals is a product of coefficients h, the input vector VI comprising the plurality of received audio signals, and the steering matrix VM, VO=(h*VM)*VI.

12. The method of claim 11, wherein the steering matrix VM is calculated as a product of an adjustment vector g and a steering vector VS, VM=g*VS.

13. The method of claim 12, wherein g is $[1, e^{+j\tau}, e^{+j2\tau}, \ldots e^{+j(N-1)\tau}]^T$, VS is $[1, e^{-j\tau}, e^{-j2\tau}, \ldots e^{-j(N-1)\tau}]$, j is an imaginary number, and i is a phase shift for each audio signal.

14. The method of claim 1, wherein at least one of the plurality of received audio signals is a reference signal for at least one other received audio signal.

15. The method of claim 1, further comprising digitizing the plurality of received audio signals.

16. A program product comprising a non-transitory computer readable storage medium storing machine readable code executable by a processor to perform:

spatially filtering a plurality of received audio signals to increase the signal-to-noise ratio in one or more corresponding output audio signals; and preserving a phase shift of at least one received audio signal in the corresponding output audio signal.

17. The program product of claim 16, wherein at least one of the one or more output audio signals is a mono output audio signal shifted by a predetermined phase.

18. The program product of claim 16, wherein the one or more output audio signals comprises an output vector of spatially filtered output audio signals with preserved phase shifts.

19. The program product of claim 16, wherein the one or more output audio signals is a product of an input vector and a steering matrix.

20. The program product of claim 19, wherein an output vector VO of the one or more output audio signals is a product of coefficients h, an input vector VI comprising the plurality of received audio signals, and the steering matrix VM, VO=(h*VM)*VI.

* * * * *